United States Patent [19]

Bader et al.

[11] 4,216,859

[45] Aug. 12, 1980

[54] CAN CLIP AND PACKAGE

[75] Inventors: James S. Bader, Lakewood; James C. Sciacca, Westminster, both of Colo.

[73] Assignee: Adolph Coors Company, Golden, Colo.

[21] Appl. No.: 5,435

[22] Filed: Jan. 22, 1979

[51] Int. Cl.[2] ..... B65D 71/00

[52] U.S. Cl. ..... 206/159; 294/87.2

[58] Field of Search ..... 206/159-160, 206/821; 294/87.2, 87.28

[56] References Cited

U.S. PATENT DOCUMENTS

| | | | |
|---|---|---|---|
| 3,038,599 | 6/1962 | Poupitch | 206/159 |
| 3,143,210 | 8/1964 | Heydon | 206/159 |
| 3,202,447 | 8/1965 | Whaley et al. | 294/87.2 |
| 3,357,551 | 12/1967 | De Shazor, Jr. | 206/159 |
| 3,410,398 | 11/1968 | Arneson | 206/159 |

*Primary Examiner*—Herbert F. Ross
*Attorney, Agent, or Firm*—Kyle W. Rost

[57] ABSTRACT

A clip for joining together a plurality of cans having a chime on their upper edge employs a body supporting a chime-engaging hook at its lower end and a spaced pair of chime-engaging tabs at its upper end, all of which cooperate to engage one can chime. The body is flexibly hinged between portions dedicated to engage each can so that the hook and tabs engaging one can are not deformed by pivotal motion of other cans in the clip. For greatest material efficiency each hook engages the chime over an arc segment, and the tabs engage the chime over a non-overlapping arc segment at each end of the segment engaged by the hook. The tabs extend downwardly against the inside chime surface to abutment with the can end. A cover sheet may be used in association with the clip, and may have a peripheral skirt protecting the can sides.

15 Claims, 7 Drawing Figures

CAN CLIP AND PACKAGE

BACKGROUND OF THE INVENTION

1. Field of the Invention

The invention relates to a special receptacle or package, and especially to a portable segregating carrier for plural cylindrical beverage-type receptacles. The disclosed carrier is of the receptacle chime or closure cap flange engaging type, wherein a clip-type retainer interlocks with chimes of juxtaposed receptacles. The invention also relates to a multiunit package wherein a clip attaches to the chime on the upper end of the cylindrical containers and provides finger hole carrier means for ease of transportation and handling.

2. Description of the Prior Art

Modern packaging of cans employs a variety of carriers such as paperboard cartons and plastic bands. The prime criteria of an acceptable package are that the cost of material and assembly is reasonable for mass use; that the package has sufficient strength to maintain its integrity throughout shipping and handling; and that the package has an attractive, clean appearance for public approval. Secondary features may vary with the preferences of the individual user, but it is often desirable to have sufficient space for a product name or other information on the package.

Among those carriers known in the prior art, plastic band carriers are disclosed in U.S. Pat. Nos. 2,874,835 and 2,936,070 to Poupitch. This type of carrier is formed from a sheet of plastic material with a plurality of can-receiving apertures therein that engage each can perimetrically under the upper chime. Although plastic band carriers of this type may be used only once, their relatively low cost makes them an attractive alternative to the older, well known paperboard carton.

Related to these band carriers are sheet carriers wherein a sheet of plastic material may have a plurality of can receiving pockets formed therein. This type of carrier is desirable because each can top is protected against dirt by the pocket during transportation. With the development of beverage cans that retain a manually opened tab in the can end, it has become increasingly important to assure that the tab and can end are clean, since the tab is often bent downwardly into the contents of the can. U.S. Pat. No. 3,331,500 discloses one such carrier. A disadvantage of this type of carrier is that it requires a great quantity of compositional material. Another disadvantage is that the cans must be retained by 360 degree engagement of the formed pocket, with the result that condensation is formed and retained between the can and the carrier pocket, requiring that the pocket be vented in some manner. A further disadvantage is that, despite the 360 degree engagement and the large quantity of material already employed in the carrier, can retention is sometimes inadequate.

Clip carriers have been proposed, wherein a plastic or metal clip attaches to only a small portion of the can chime, usually by means of a hook under the chime and a cooperating tab inside the chime radius. U.S. Pat. Nos. 2,838,818 to Brennan, 2,863,556 to Bedford, 2,876,896 to Ziehmer, 2,879,897 to Taylor, and 2,923,405 to Poupitch teach a variety of clip structures wherein the clip is constructed of a relatively strong material such as sheet metal. In practice, metal clips have proven unsuitable for use on metal cans because of friction damage and relatively high cost. Also, metal clips are a source of litter and for that reason are unacceptable.

Several plastic clip carriers have been proposed, as represented by U.S. Pat. Nos. 3,206,019 to Curry, and 3,370,700 to DeShazor. The primary problem with plastic clips is adequate retention of the cans in the clip. The flexibility and natural lubricity of most plastics allows the cans to separate from the clip under relatively minor forces. To overcome this tendency, it has been proposed to use a plastic clip on both the upper chime and lower chime of cans, thus holding the cans in firm position within a single multiunit package. This possible solution failed with the advent of the two-piece can, which is formed from a single cup-like can body with an end closure on only the top end thereof with the result that the can has an upper chime but no lower chime. In addition, placing a clip on both the top and bottom of a can package doubles the cost of the necessary material, as compared to a package requiring a clip on only one end of each can.

Largely because of the cost and can retention problems, the clip carrier is not known to have achieved widespread use or popularity. The present invention offers a solution to the problem of can retention while employing a clip on only one end of each can in a multiunit package. In addition, the quantity of material required to unite a standard package of six cans is smaller than amount of material used in the present day band carrier of the type noted above. The present invention thus offers a solution to the problems that have thus far prevented widespread employment of clip carriers in the multiunit can packaging industry.

SUMMARY OF THE INVENTION

In a clip carrier for a multiunit can package, a clip of the type having a hook for engaging the underside of the can chime and a tab for engaging the radially inner side of the chime have the hook and tabs offset along the arc of chime so that the hook occupies the central portion of the contact area, and the tabs occupy the opposite ends of the chime contact area but the tabs are not directly opposite from any portion of the hook along the arc of the chime. The body of the clip covers the interstices of the grouped cans in the multiunit package with each clip being most commonly joined to four cans arranged in a square, and therefore having perpendicular axes passing between the abutting cans. The clip is flexible along these axes so that each pair of neighboring cans can pivot from the opposite pair with minimum stress on the hook and tabs engaging the can. The holding force between the clip and can chime are especially great when the height of the tab is equal or slightly greater than the radially inward facing side of the chime so that the tabs abut the top end surface of the can.

The main object of the invention is to create a carrier for cans having at least one chimed end, wherein the carrier contains a minimum of material. A can clip formed of synthetic resin material has therefore been created wherein less than one-quarter of each can chime need be engaged, and the hook and tab portions of the clip need not be directly opposite from each other, and, in fact, achieves substantial material savings without loss of holding power by eliminating any cooperative tab portion directly opposite from the hook.

An important object is to create a clip type carrier that will retain its carried cans through normal handling, yet requires very little constituent material. A flexible clip has been found to retain its grip on a carried can while employing very little material in the clip. Specifically, by creating a flexible area or hinge that extends along a line between the carried cans, the clip is able to retain the cans without attempting to resist angled movement between rows of cans in the package. If such movement is induced, the clip bends to permit the movement, but all bending takes place in areas of the clip other than in the hook and tab portions engaging a single can. Therefore, the hook and tab may contain a minimum quantity of material, as there is no requirement for the hook and tab above to resist the bending between cans.

A further important object is to create an environmentally acceptable can carrier. The plastic compositional material may be photo or thermally degradable, and the presence of thin hinge areas in the clip aids degradation by first yielding to the degradative influences, subdividing the clip into smaller pieces that are correspondingly less visible and increasingly subject to further degradation. Alternatively, the clip permits manual reloading onto the empty cans of the original package for use in returning the cans for recycle.

Another object is to create a can carrier that permits the tops of the cans to be covered, if desired, for sanitary reasons. The present clip accomodates a cover sheet over the cans and retains the cover sheet in place by overlapping a small part of the sheet at the abuttment between the cans.

These and other advantages of the clip have been obtained as more fully described below.

DESCRIPTION OF THE PREFERRED EMBODIMENT

Figure 1:
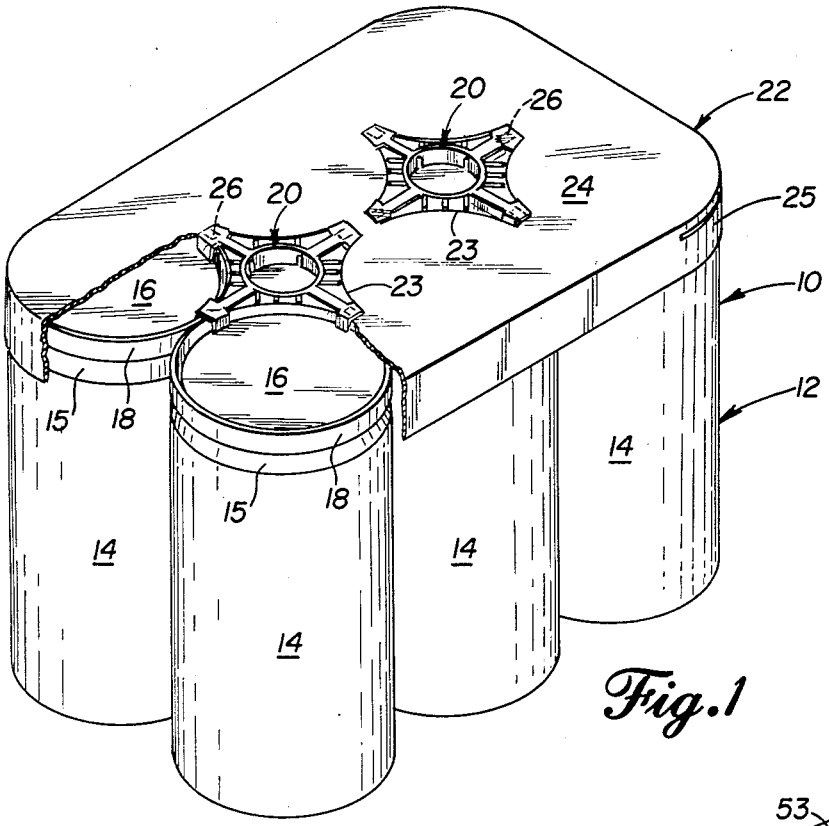
FIG. 1 is an isometric view of a multiunit package of six cans employing the clip and cover sheet, with a portion of the cover sheet broken away.

The invention is best understood by initial reference to the multiunit package 10 shown in FIG. 1, wherein a plurality of cylindrical containers such as beverage cans 12 are arranged in side-by-side relationship of perpendicular rows and columns to form a package of two rows with three cans in each row. The cans are shown to be the presently existing two-piece type wherein each can is formed from a body 14 of cylindrical shape with an integral bottom wall, but at the upper end of each can body, the wall is necked at 15 to permit a can end 16 to be fastened over the top of the body without resulting in the chime 18 extending radially beyond the non-necked portions of the body. When the cans are assembled into side-by-side position and resting on a flat horizontal surface, the adjacent non-necked portions of the body walls may be almost in tangential contact, for example separated by 1/16 inch, but as soon as the package is raised by its top, the lower portions of the cans will come together and thereby contribute to the overall firmness of the carried package. The chimes of adjacent cans may be slightly spaced, for example by 3/32 inch.

Additional portions of the multiunit package 10 include a clip 20 and, optionally, cover sheet 22. Each clip 20 is releasably connected to a plurality of cans 12, for example to four such cans, and a plurality of such clips may be combined to form a package having more units than permitted by the capacity of a single clip. The preferred package employs two clips to unite a total of six cans, wherein the center two cans of each row are attached by both clips. This arrangement provides a convenient means for carrying the entire multiunit package by means of a pair of finger holes located in the centers of the two clips. The cover sheet fits over the can package in cooperation with the clips and preferably has apertures 23 shaped to expose the clips. Each cover sheet includes a top wall 24, and, optionally, a side skirt 25 depending from the top wall at the edges of the package. Although the skirt is illustrated in FIG. 1 to extend downwardly for only a fraction of the total package height, the skirt may extend for the entire package height if desired to provide complete lateral protection for the cans. The cover sheet may be formed from any suitable material such as paperboard or a plastic. The skirt may have a contoured configuration to engage the necked-in portion of the cans as an aid in retaining the cover sheet in place on the package, but the preferred means of retaining the cover sheet in place is by corner tabs 26 underlying a portion of the clips, preferably between adjacent cans.

The clip 20 consists of a body having a discrete portion dedicated to engagement with each carried can, and a flexible or hinged area between each such discrete portion. Each discrete portion includes suitable can chime engaging means that generally follows the arc of the chime. The chime engaging means may include a central arcuate hook for engaging the under side of the chime, and a chime retaining tab at each of the opposite ends of the hook and following the arc of the inside of the chime. For greatest material efficiency, the hook and the retaining tabs occupy nonoverlapping segments of the chime arc, although the hook and tabs preferably occupy adjacent segments. Each tab is connected by a suitable wall to its associated hook, which wall passes over the top of the can chime and down the outer side of the chime to the hook. The same wall passing over the top of the chime or a different wall extends across the boundry between adjacent cans in the carrier and is connected to the hinge that allows adjacent cans to pivot relative to each other. This hinge is preferably on the tangent to both adjacent cans.

Figure 2:
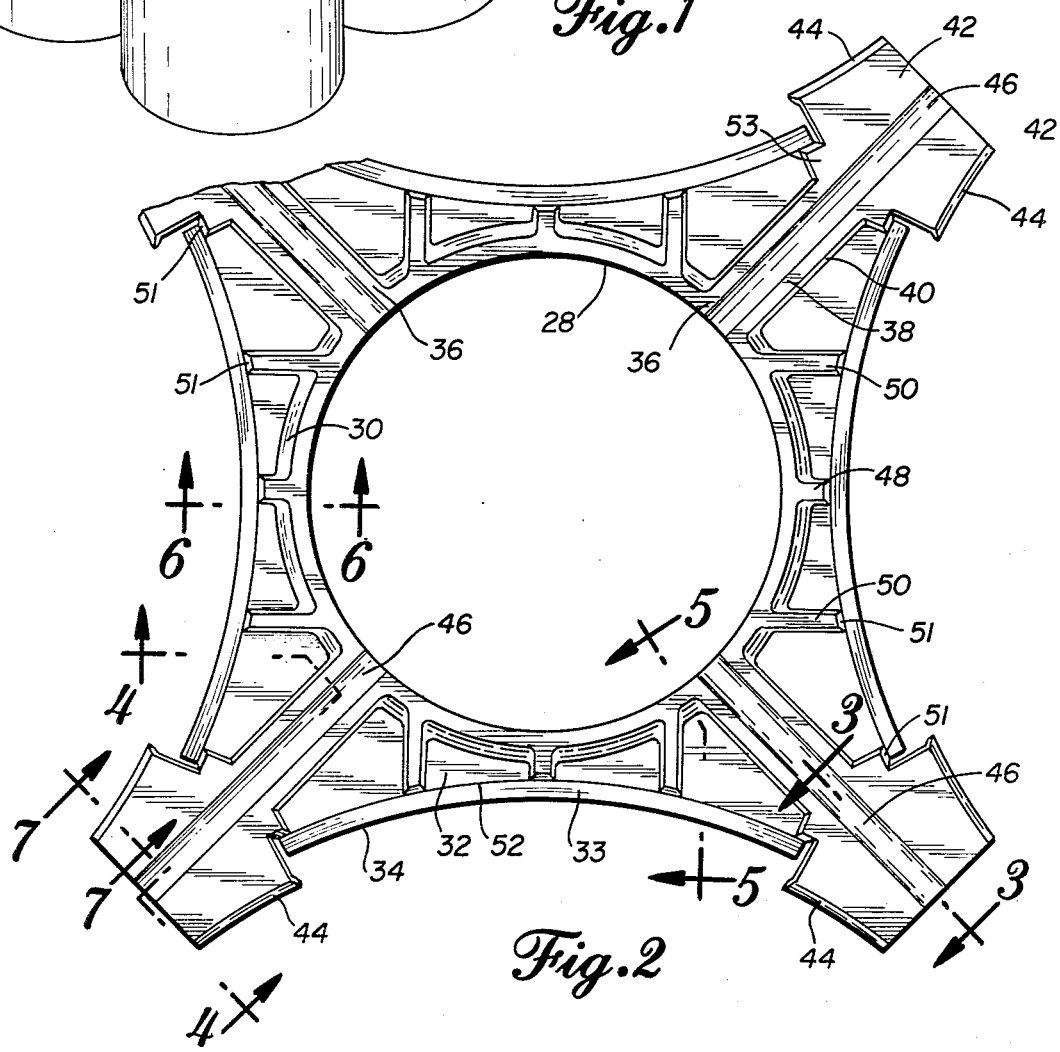
FIG. 2 is a top plan view of one of the clips.

In FIGS. 1 and 2 the clip is shown in an embodiment wherein each clip engages four cans arranged in a square with each can tangentially contacting two others, and the clip covers the interstice created by the four can grouping. For convenience of description, the clip may be described as always attaching to the top end of a can package and therefore resting in a substantially horizontal plane. The center of the clip body may be conveniently shaped as circle 28 for use as a finger engagement. The circle may be viewed as having four equal quadrants in the present embodiment, one dedicated to the retention of each can in the four can package. In each quadrant, the body is defined by a generally upstanding wall 30 which may have a downward and radially outward angle of, for example, 12½ degrees from vertical, and have at its lower edge a shelf 32 extending radially outwardly from the circle and terminating with surface 33 angling upwardly, for example at 45 degrees, and having outward edge 34, which has an arc of, for example, 51 degrees, and radius corresponding to the radius of the necked portion of the cans in the multiunit package.

The quadrants of circle 28 are defined by horizontal perpendicular axes along which channel arms 36 extend outwardly from the circle, for example for 1.125 inches from the center of the circle. The channel top wall 38 may originate directly at circle 28, and channel side walls 40 may originate in wall 30, interrupting the continuity of wall 30 between the side walls of each arm 36. Together, the top and side channel walls form an inverted U shaped channel. The top wall 38 of each arm 36 extends outwardly from circle 28 beyond the termination of sides 40 and spreads laterally from the axis of the channel to form a wider top wall 42 at the outer end of arm 36. Retaining tabs 44 depend from the opposite sides of wall 42.

Figure 3:
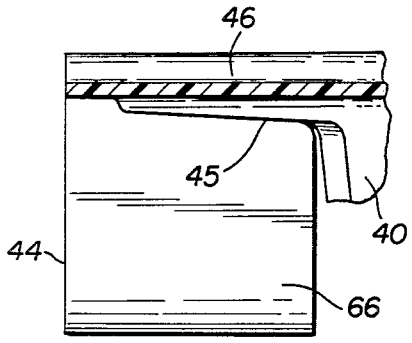
FIG. 3 is a sectional view taken along the plane of line 3—3 of FIG. 2.
Figure 4:
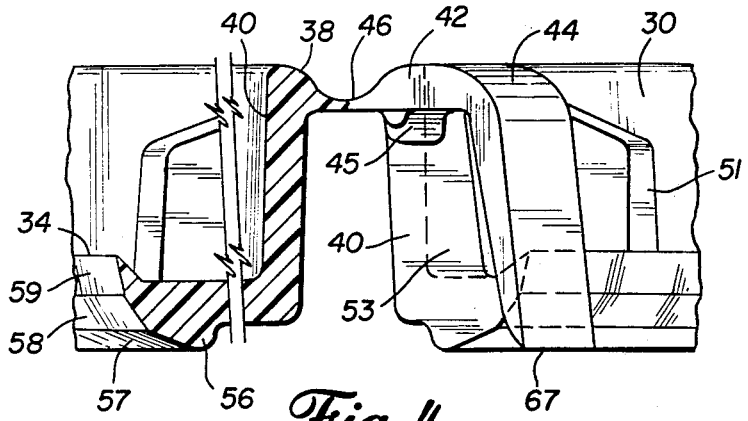
FIG. 4 is a sectional view taken along the plane of line 4—4 of FIG. 2.

As best shown in FIGS. 3 and 4, the channel wall 40 extends vertically between shelf 32 and channel wall 38 and outwardly from wall 30 to a point near the origin of tab 44. A reinforcing rib 45 may continue outwardly from each wall 40 on the lower side of channel wall 38 to vertically support wall 42 after the termination of wall 40. The top wall of each channel arm 36 may have a groove 46 extending radially from circle 28 to define a flexible hinge area of thin plastic, for example, 0.010 inch thick, between the opposite sides 40 and tabs 44, and this hinge would likewise pass between ribs 45 of adjacent quadrant edges.

Figure 5:
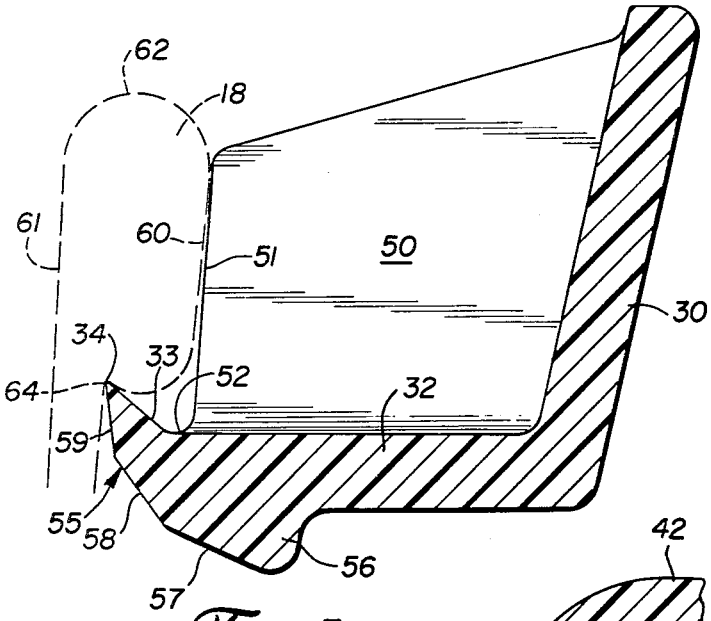
FIG. 5 is a sectional view taken along the plane of line 5—5 of FIG. 2, and with the can chime added in phantom for clarity.
Figure 6:
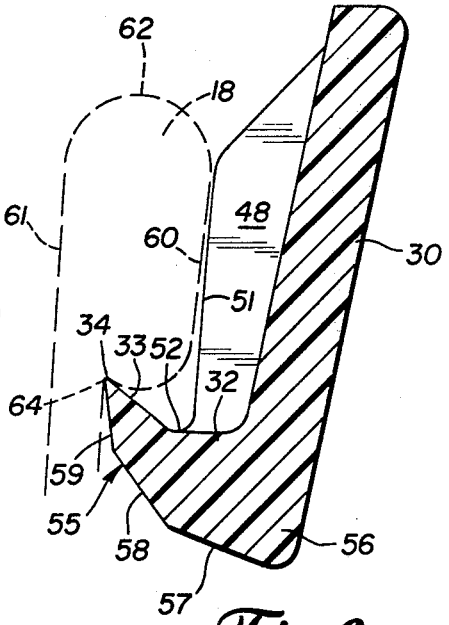
FIG. 6 is a sectional view taken along the plane of line 6—6 of FIG. 2, and with a can chime added in phantom for clarity.

In FIGS. 5 and 6, the generally upstanding wall 30 and shelf 32 are connected to projecting support ribs 48 and 50. The central rib 48 may extend radially outwardly from wall 30, while ribs 50 of the same quadrant may be parallel to rib 48. Each of these ribs has an outwardly facing abutment surface 51 intended to contact the outer face of the can chime 18 when the clip is engaged with the chime. Each rib terminates at its lower end near intersection 52 between the shelf and surface 33, so that the hook 55 extends outwardly beyond the rib for a sufficient distance to be fully engaged under the chime. A rib 53 similar to ribs 48 and 50 may be located between the shelf and channel wall 40 immediately before the end of wall 40, as best shown in FIGS. 2 and 4.

The lower surface of shelf 32 may be reinforced by an arcuate rib 56 underlying the portion of the shelf nearest hook 55. The bottom 57 of the rib 56 may slope upwardly and outwardly at an angle such as 65 degrees from vertical, after which the bottom surface 58 of the hook slopes upwardly at a steeper angle such as 40 degrees to vertical, and finally the front surface 59 of the hook angles at the steepest angle, such as 7½ degrees to vertical, terminating at the union with edge 34. The hook is thus provided with sufficient reinforcement to bear the weight of a carried can, while the edge 34 is relatively thin and is able to nest between the can chime and necked wall 15 for a tenacious grip. In addition, the shape of the rib and hook tend to guide the hook over the outer surface of the can chime during installation.

Figure 7:
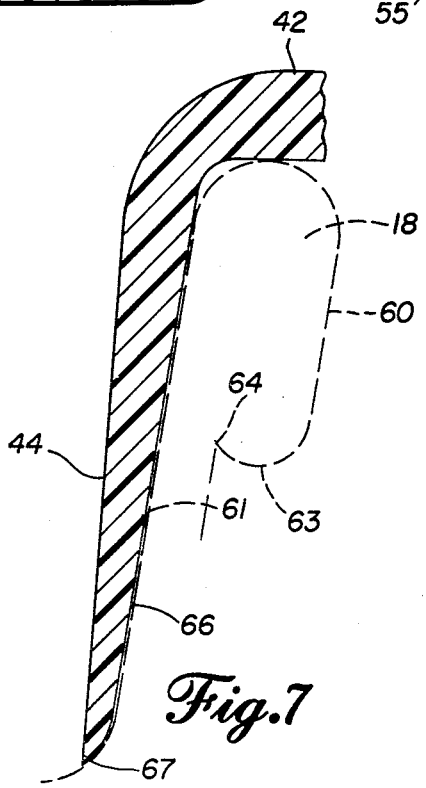
FIG. 7 is a sectional view taken along the plane of line 7—7 of FIG. 2, and with a can chime added in phantom for clarity.

The typical can chime 18 may be viewed as having four distinct sides, as viewed in FIGS. 5–7. The outer side 60, which abuts surfaces 51 or ribs 48, 50 and 53, is annular and is concentric with inner side 61. These two sides converge to form a curved top surface 62. Outer side 60 also curves inwardly toward the container wall 15 at its lower end to form bottom surface 63, which forms a groove or crevice 64 as it curves upwardly at its meeting with wall 15. The vertical heights of the chime is determined between surfaces 62 and 63, and may be, for example, 0.135 inch, while the distance from the point of chime groove 64 to top 62 may be 0.115 inch. Between surfaces 60 and 61, the chime may have thickness of 0.060 inch, while the distance from top 62 to the base of inner surface 61 may be 0.280 inch. The clip is preferred to be proportioned for the specific size of can with which it will be used. For instance, the outer chime surface 60 may have an arc of radius 1.220 inches, corresponding to the arc of intersection 52, and the necked can wall 15 may have an arc of radius 1.1825 inches, corresponding to the arc of edge 34. Along the arc established by the hook 55, the rib abutment surfaces 51 are radially spaced from the retaining tabs 44 by the approximate thickness of the bead, and the hook edge 34 is spaced vertically from wall 42 by the approximate distance from chime crevice point 64 to top 62. The distance from the shelf 32 to wall 42 is sufficiently great that the shelf does not interfere with entry of the hook into the crevice, and may be, for example, 0.140 inch. Each tab 44 is preferred to have a vertical dimension at least as great as the chime surface 61 so that the tab abuts the horizontal surface of the can end at the base of surface 61 to urge the hook firmly into the crevice 64. Surface 61 may angle downwardly and inwardly toward the center of the can end at an acute angle such as 10 degrees, while the opposed surface 66 of tab 44 angles toward the can end center at a smaller angle such as 8 degrees, so that the engagement between the tab and chime is quite snug and tends to urge the hook 55 against the can wall 15.

Assembly of the multiunit package 10 involves sliding both tabs 44 of each quadrant downwardly over the inner surface 61 of a can chime, while sliding the hook 55 downwardly over the outer chime surface 60, during which time the tab and hook flex apart to permit the chime to enter the clip. The hook engages the under side of the chime and, specifically, the crevice 64 at the approximate time that the lower tip 67 of each tab 44 abuts the can end 16 and the under side of wall 42 contacts the upper chime surface 62. The rib 45 closest to each tab 44 is outside to the outer chime surface.

In the assembled package, one quadrant of each clip is dedicated to engagement with a single can. The top channel wall 38 is substantially the only structure of the clip joining the quadrants, and because of the flexible nature of this wall, the cans have the ability to bend relative to one another in the package without placing undue stress on that clip quadrant specifically dedicated to engaging the can. In particular, the two pairs of opposite axially aligned arms 36 define an intersecting pair of perpendicular axes that extend between each pair of adjacent cans retained in a single clip so that any two adjacent cans may pivot at an acute angle to the opposite pair within the clip, or in the embodiment of FIG. 1, a row of three cans may pivot at an angle to the opposite row of three cans. This hinged feature of the clip enables cans to be maintained in a package while requiring a minimum quantity of compositional material in the clip.

From the above description, each quadrant of the clip will be understood to have a relatively stiff body structure designed to resist bending in the vertical plane. The upstanding wall portion 30 and its continuation in the generally upstanding channel side walls 40 serve as means to support the hook at the level of the chime bottom while supporting the tabs 44 from the top of the chime. The shelf 32 forms an L shape in combination with either sides 40 or 30 and therefore stiffens the clip against deformation in the horizontal plane. Ribs 48, 50 and 53 prevent bending of the shelf in the vertical plane relative to walls 30 or 40, while at the same time allow wall 30 to diverge from the hooked edge of the shelf and to form a comfortably shaped circle 28 for finger engagement. Channel top wall 38 serves primarily as a flexible web between quadrants, except that top wall portion 42 acts as means to connect tabs 44 on the inside of the chime to the clip body supporting the hook on the outside of the chime.

Variations in the precise configuration of the clip, in the number and position of the carried cans, and in suggested dimensions are possible. Therefore, the above description should be understood to be for purposes of example and not limitation.

I claim:

1. An improved clip of the kind for engaging a segment of the chime on a single end of a predetermined plurality of approximately axially parallel cans to form a multi-can package, the clip being of the type having a clip body with a plurality of discrete portions, each intended for association with at least one of said plurality of cans, and having a plurality of discrete means for engaging a segment of a can chime, said means being located at spaced positions about the perimeter of said body, at least one chime engaging means being associated with each of said discrete body portions, wherein the improvement comprises at least one line of weakness separating adjacent discrete body portions for relative bending between chime engaging means without substantial deformation of the chime engaging means during axial nonalignment, in use, of the cans engaged in the chime engaging means.

2. The clip of claim 1, wherein said body comprises a plurality of generally upstanding body wall segments corresponding in number to said predetermined plurality of cans, each such body wall segment connected to an associated chime engaging means, and wherein said line of weakness comprises a flexible plastic web connected between neighboring wall segments.

3. The clip of claim 2, of the type wherein each chime engaging means includes a hook for engaging the chime groove and a pair of retaining tabs for engaging the chime inner face, the hook defining a central arc segment and each tab defining a non-overlapping arc segment at each end of the central arc segment, and the body wall segments are arcuate and define a generally planar, circular central aperture in the body for finger engagement, wherein the improvement further comprises:

(a) an associated shelf extending laterally outwardly from each segment approximately parallel to said aperture plane, the shelf carrying the hook of said associated chime engaging means at the outward edge thereof; and (b) a plurality of ribs connected between each body wall segment and its shelf, each rib having an outwardly facing chime abutment surface set inwardly from the hook.

4. The clip of claim 3, wherein said clip body further comprises a generally upstanding side wall extending from each end of each hook arc segment to a corresponding end of the associated body wall segment, each such side wall segment being connected to the associated shelf at its lower end and to a retaining tab supporting wall at its upper end.

5. The clip of claim 4, wherein said retaining tab supporting wall is connected between two side walls associated with adjacent segments, and said plastic web comprises a grooved area of the retaining tab supporting wall extending radially from said circular central aperture.

6. A clip carrier adapted to engage a plurality of vertically oriented substantially identical juxtaposed cans having a chime on the upper end thereof, a segment of which comprises:

(a) an arcuate wall segment partially defining a central annular aperture in the clip and having a height greater than the height of a can chime that, in use, the clip is intended to engage;

(b) a rigid shelf extending radially outwardly from the annular wall near the lower edge thereof, terminating at its outward edge with an arcuate, upwardly angling hooked edge for engaging under the lower face of a can chime, the arc of the wall segment and the arc of the hooked edge being concave into the shelf;

(c) a retaining tab at each opposite end of the hooked edge for overlying the inner face of the can chime, having a top wall for extending over the top of the chime and connecting the tab to the remainder of the clip;

(d) a side wall extending radially outwardly from the annular wall, rigidly connected near its lower edge to said rigid shelf and near its radially outward edge to said retaining tab top wall; and (e) a web containing a radially extending flexible line of weakness connected to the top of the side wall and extending to the side wall of an adjacent segment of the same clip to provide a flexible union between clip segments.

7. An improved multi-can package of the type having at least four vertical cylindrical cans grouped in rows and columns to form an interstice in the center thereof, having a chime at their upper ends, and joined by a clip, wherein the improvement comprises:

(a) a clip body formed from synthetic plastic material for natural lubricity between the clip and the cans, the clip body overlying the interstice at a single end of the package and having a generally upstanding body wall segment associated with each can and together defining a central clip opening for carrying engagement;

(b) each of said body wall segments being symmetrically associated with its can and having an arcuate hook on the lower outer edge thereof engaging the groove of the chime, the arc of the hook substantially corresponding to the arc of the can immediately at the chime;

(c) a retaining tab at each end of said arcuate hook engaging the inner face of the chime;

(d) a connecting wall attached to the top end of each retaining tab, passing over the top surface of the chime, and connected to said associated body wall segment; and (e) a flexible plastic web defining therein a line of weakness for permitting bending between cans in the package at the line of weakness, said web extending between adjacent connecting walls of neighboring upstanding wall segements and unifying the package.

8. The package of claim 7, wherein said body wall segments comprise four approximately quarter-circle segments defining a circular central opening; and further comprising a horizontally outwardly extending shelf connected between each segment and its associated arcuate hook.

9. The package of claim 8, further comprising a vertical rib connected between said shelf and body wall segment and having a laterally facing chime abutment surface contacting the outer face of said chime.

10. The package of claim 8, wherein said clip further comprises a side wall segment extending toward the hook from the opposite ends of each body wall segment, attached at its lower edge to the shelf and connected at its upper edge to said flexible plastic web; and wherein said retaining tab connecting wall extends from the top of each tab to the top of one of said side wall segments immediately adjacent to the flexible plastic web.

11. The package of claim 7, wherein each of said retaining tabs has a height at least equal to the height of the inner surface of the chime.

12. The package of claim 7, further comprising a cover sheet overlying the tops of the cans.

13. The package of claim 12, wherein said cover sheet comprises a top wall having an aperture therein exposing the central clip opening.

14. The package of claim 13, wherein said cover sheet further comprises a side skirt depending from the top wall at the edges of the package.

15. The package of claim 13, wherein said cover sheet further comprises a corner tab underlying a portion of said plastic web for retaining the cover sheet on the package.

* * * * *